US007338263B2

(12) United States Patent
Young

(10) Patent No.: US 7,338,263 B2
(45) Date of Patent: Mar. 4, 2008

(54) METHOD AND APPARATUS FOR COMPRESSOR RE-MANUFACTURE

(75) Inventor: Terence William Thomas Young, Gravesend (GB)

(73) Assignee: J & E Hall Ltd., Dartford (GB)

( * ) Notice: Subject to any disclaimer, the term of this patent is extended or adjusted under 35 U.S.C. 154(b) by 0 days.

(21) Appl. No.: 11/283,800

(22) Filed: Nov. 22, 2005

(65) Prior Publication Data

US 2007/0116589 A1 May 24, 2007

(51) Int. Cl.
*F01C 1/02* (2006.01)

(52) U.S. Cl. ..... 418/55.1; 418/55.2

(58) Field of Classification Search ..... 418/55.1, 418/55.2, 55.3, 55.4
See application file for complete search history.

(56) References Cited

U.S. PATENT DOCUMENTS 5,224,849 A * 7/1993 Forni ..... 418/55.5
5,320,506 A * 6/1994 Fogt ..... 418/55.3
6,043,643 A * 3/2000 Message et al. ..... 324/174
6,155,805 A * 12/2000 Fry ..... 417/415
6,655,172 B2 * 12/2003 Perevozchikov et al. ..... 62/505

FOREIGN PATENT DOCUMENTS

JP 58-44288 3/1983
JP 61-215487 9/1986
JP 04-132894 5/1992

* cited by examiner

*Primary Examiner*—Hoang Nguyen
(74) *Attorney, Agent, or Firm*—Nixon & Vanderhye P.C.

(57) ABSTRACT

In a method of repairing a scroll compressor, the casing 100 of the compressor is cut open by making two transverse cuts through the casing to give access to the internal components of the compressor. The casing 100 is then resealed, using two annular reinforcing structures 300, one at each cut, to conserve the dimensions of the casing 100. This allows a scroll compressor to be repaired and re-assembled without losing the fine positioning of internal components which are held in place by the casing 100. Each annular reinforcing structure 300 comprises a ring 310 with an outwardly directed flange 305. The flange 305 has a thickness chosen to conserve the dimensions of the re-assembled casing while allowing single-pass welding and the ring 310 has a length which is chosen to provide at least location of the cut surfaces of the casing 100 during re-assembly and, optionally, shielding to prevent weld pool, slag or splatter entering the canister 100.

3 Claims, 6 Drawing Sheets

FIGURE 3
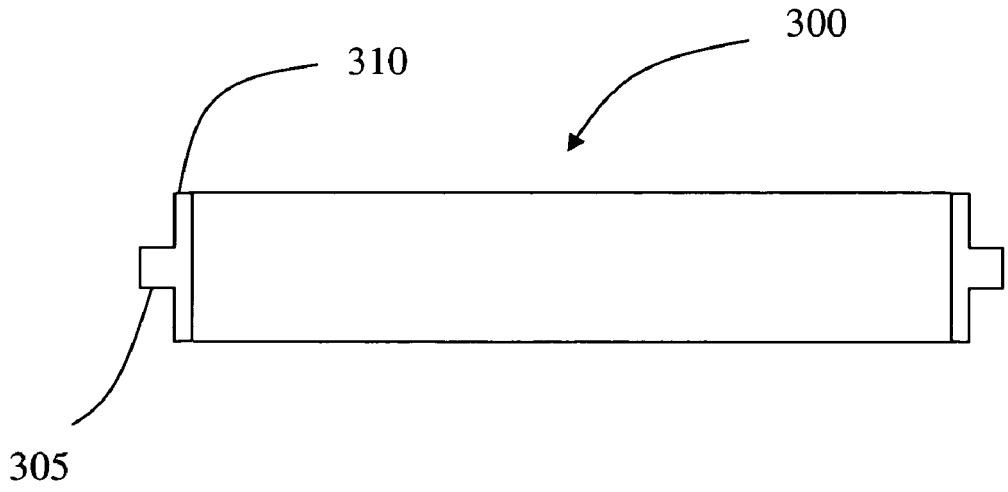
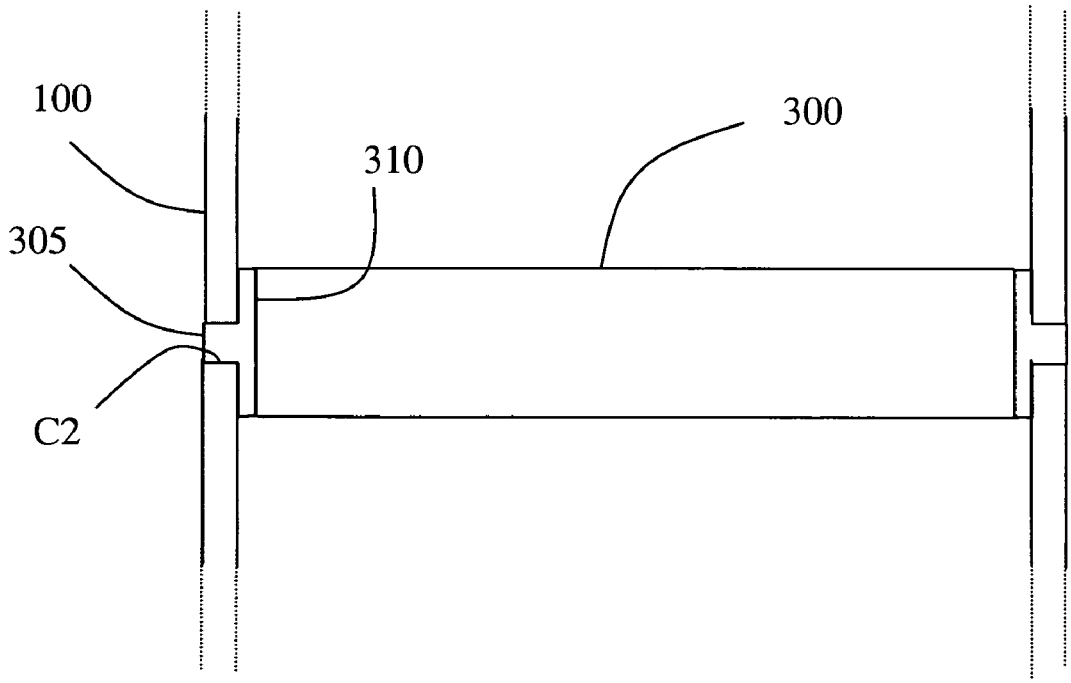
FIGURE 4

METHOD AND APPARATUS FOR COMPRESSOR RE-MANUFACTURE

TECHNICAL FIELD OF EXEMPLARY NON-LIMITING EMBODIMENTS OF THE PRESENT INVENTION

The present invention relates to methods and apparatus for compressor re-manufacture.

BRIEF DESCRIPTION OF RELATED ART

Compressors are known for use in cooling, for example for use in refrigeration and air conditioning units. They generally comprise a compression mechanism for compressing a gas so that it can be rapidly expanded, producing cooling.

Known compressors are of different types, for example screw compressors and scroll compressors. In a scroll compressor, two parts of generally spiral cross section are interleaved. Gas enters a pocket at an outer edge between the two spiral surfaces and is trapped and moved towards the centre of the spirals by a cranked motion of one spiral surface against the other. As the gas nears the centre of the spirals, it becomes fully compressed and exits at the centre. Scroll compressors are described for example in the following paper: "Scroll Compressor Design and Application Characteristics for Air Conditioning, Heat Pump, and Refrigeration Applications" by J P Elson, G F Hundy and K J Monnier, published in the Proceedings of the Institute of Refrigeration 1990-1991, 2-1.

Screw compressors have long been subject to repair and remanufacture for maintenance purposes. However, this has not been possible with scroll compressors. Although the two scroll components providing the spiral surfaces may be designed with a degree of axial and radial compliance, there are other factors which come into play. For example, the scroll components may be loaded together axially to bring each vane tip into contact with the opposing scroll base. According to the paper referenced above, "This demands great precision of the vane heights of the mating scroll components and consequently a highly sophisticated manufacturing process."

Scroll compressors are hermetically sealed in a welded, pressure-tight container. To repair a scroll compressor would mean opening this pressure-tight canister. However, the canister is formed and assembled to position the internal components in relation to each other with the great precision required. No provision is made for opening the canister and there is no known method for opening a canister, repairing working parts and reassembling the compressor to give adequate subsequent performance. Although it is perfectly possible to cut open the canister with cutting equipment and to weld it back together after repair or maintenance, this destroys the original factory set component positions and it would be extremely difficult, probably impossible, to re-establish the components correctly upon reassembly. Further, debris can be introduced to the inside of the canister.

BRIEF SUMMARY OF EXEMPLARY NON-LIMITING EMBODIMENTS OF THE PRESENT INVENTION

According to a first aspect of embodiments of the present invention, there is provided an annular reinforcing structure for use in remanufacturing scroll compressors having a casing which provides positioning for internal components, the annular structure having a T-shaped, or substantially T-shaped, cross section provided by a ring with an outwardly projecting flange positioned partway along the outer surface of the ring, the flange comprising weldable material, having a thickness of not more than 10 mm and being arranged, in use, to be welded between opposing cut surfaces of a reassembled compressor casing.

Preferably, the ring has an outer surface which, in use, abuts the inner surface of the casing to either side of the flange. The outer surface of the ring is preferably flat or concave and provides an interference fit with the inner surface of the casing. This ring part of the annular structure, extending inside the remanufactured casing, has at least two functions, one being to re-align the cut parts of the casing for welding and the other being to act as a shield against any weld splatter and slag. Re-alignment of the cut parts is facilitated where the outer surface of the ring provides an interference fit with the inner surface of the casing. To act as an effective shield, the outer surface of the ring preferably extends away from the weld in each direction sufficiently far to prevent any weld pool, splatter or slag from penetrating the canister during reassembly. For example, it has been found sufficient that the outer surface of the ring extends away from the weld in each direction to approximately twice the wall thickness of the casing in the weld area. Typically, this will mean the overall dimension of the ring in the longitudinal (or axial) direction of the casing, in use, is at least 8 mm. If, however, a welding technique is used which generally avoids entry of material to the canister and the primary purpose of the ring is to provide location rather than a shield, then the length of the ring in the axial direction can be reduced. A working minimum for the length of the ring in the axial direction in this situation has been found to be 0.5 mm greater than the thickness of the flange, giving 0.25 mm at each end of the ring for use in locating the cut parts of the casing for welding.

The reinforcing structure comprises a material such as low carbon welding grade steel which can be welded in reassembly of a compressor casing so as to produce a repaired casing with sufficient strength and positional accuracy to support subsequent use of the compressor. The reinforcing structure must be manufactured of a suitable grade material to be compatible with and ensure a full penetration weld can be achieved with the material of the compressor casing.

In practice, the annular reinforcing structure has been found to have multiple advantages:

- It ensures that the original critical assembly positions can be re-established, both axially and radially, despite loss of material in cutting open the casing
- It shields the inside of the canister, preventing weld pool, splatter or other debris from entering the canister during remanufacture
- Importantly, it obviates the need for a full penetration weld to join cut surfaces of the casing with the resultant weld splatter whilst ensuring that the weld gap can still be closed with a single welding operation.

A full penetration weld, extending right through the container casing from outside to inside, would normally be done to prevent any potential gaps from which a fatigue crack could propagate. However, this has the disadvantage that weld splatter and slag can be left inside the container. Using an annular reinforcing structure according to an embodiment of the invention means that the cut edges of the casing can be welded to the flange instead of to each other, using a single welding operation taken across the flange from one side to the other. The flange and/or the central part of the ring melts to provide effectively one weld to the cut edges of the casing while the ring extends across the weld site inside the casing and provides a shield against any weld splatter and slag.

The ring will have a shape in plan view which is dictated by the cross section of the casing. This will usually be circular. However, it is not essential that it is circular since a compressor casing may in practice have an oval or other cross section.

Preferably, the thickness of the flange is kept small in order to minimise the size of the final weld. However, the cutting tool used to cut the casing open will necessarily remove material which must be replaced by material of the flange in the remanufactured casing. Otherwise, the original critical assembly positions will not be re-established. There are conflicting requirements here. If the cutting tool is too thin the tool itself may lose rigidity but a wide cut means increasing the thickness of the flange.

A complicating factor is that, although the thickness of the outwardly projecting flange can be used to substitute for material lost during cutting of the casing, the relationship is not necessarily direct. The step of welding the structure into place can in practice affect the relationship between the depth of material lost and the thickness of the outwardly projecting flange significantly. The degree to which this happens depends on the welding technique used. For example, using multipass welding, the thickness of the flange may need to be of the order of 1.5 mm greater than the width of the cutting tool. On the other hand, using metal inert gas (MIG) or tungsten inert gas (TIG) welding in one pass, the relationship can be maintained and the thickness of the flange and the width of the cutting tool can be the same.

In preferred embodiments of the invention, both the thickness of the flange and the width of the cutting tool are less than 10 mm, for instance 6 mm or more preferably 3 mm. The thickness of the flange need be no more than 2 mm, for example 1.5 mm, greater than the width of the cutting tool. If a one pass welding technique is used which avoids loss of dimension during the welding step, for instance the inert gas techniques such as MIG or TIG welding, then the thickness of the flange and the width of the cutting tool can be the same.

According to a second aspect of embodiments of the present invention, there is provided a scroll compressor comprising a reassembled casing and an annular reinforcing structure according to an embodiment of the invention in its first aspect, the reinforcing structure being welded to opposing cut surfaces of the reassembled casing to provide a seal.

According to a third aspect of the present invention, there is provided a method of repairing a scroll compressor having a casing, the method comprising the steps of:

i) opening the casing for repair of the compressor by making at least one cut through the casing to produce cut surfaces; and ii) subsequently closing the casing, including the step of welding said cut surfaces to an annular reinforcing structure having a T-shaped cross section such that the cut surfaces are welded to opposing sides of an outwardly directed flange of the reinforcing structure, the flange being mounted on a ring whose outer surface, in use, abuts an inner surface of the closed casing, wherein the closed casing is supported and sealed by the reinforcing structure.

Where the step of welding said cut surfaces results in shrinkage, the outwardly directed flange of the reinforcing structure preferably, prior to the closing step ii), has a thickness greater that the thickness of material removed in making said at least one cut. The greater thickness of the flange can then compensate for the shrinkage.

Preferably, the step of welding the cut surfaces comprises a single pass welding step. That is, the welding equipment only has to complete one circuit of the casing to complete a weld of the surfaces to the flange.

Scroll compressors normally have a generally cylindrical casing. It will usually, if not always, be appropriate that the at least one cut through the casing is made in a plane transverse to the longitudinal axis of the casing.

In order to gain sufficient access to the contents of the casing of a scroll compressor to make an effective repair, it has been found preferable to make two cuts through the casing. The step of closing the casing is then done using two annular reinforcing structures, welding the cut surfaces at each cut to a flange of a respective reinforcing structure.

It has been found possible, using embodiments of the invention, to achieve sufficient accuracy in the dimensions of the casing of a repaired scroll compressor that the compressor can be restored to working functionality. Although the requirement for accuracy in these dimensions is driven at least primarily by the design and construction of the scroll compressor, in known scroll compressors the requirement has been high. An advantage of embodiments of the present invention is that it has been found possible to achieve an accuracy in restoring the overall length of a compressor casing to the order of thousandths of an inch. For example, it has been found possible to achieve an accuracy within five thousandths of an inch in restoring the overall length of a compressor casing.

Typically, a compressor casing is of the order of eighteen or twenty inches long.

BRIEF SUMMARY OF THE DRAWINGS

The remanufacture of a scroll compressor using an annular reinforcing structure will now be described, by way of example only, with reference to the accompanying figures in which:

FIG. 3 shows a cross section through an annular reinforcing structure for use in remanufacturing the scroll compressor of FIG. 1;

FIG. 4 shows a cross section through the annular reinforcing structure and the casing of the scroll compressor of FIG. 1, after remanufacture of the casing;

It should be noted that the figures are schematic only, none being drawn to scale.

DETAILED DESCRIPTION OF EXEMPLARY NON-LIMITING EMBODIMENTS OF THE PRESENT INVENTION

Figure 1:
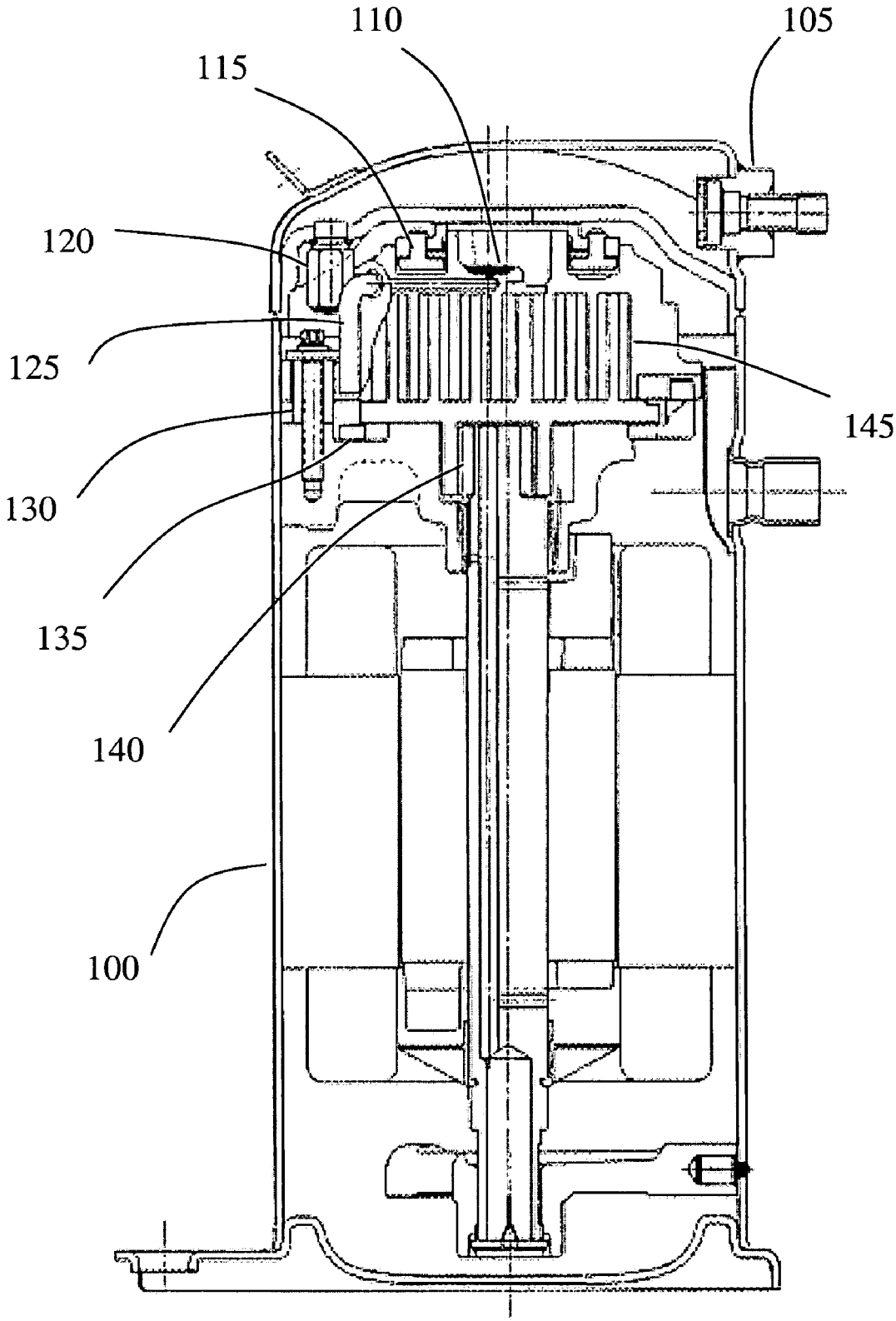
FIG. 1 shows a vertical cross section through a scroll compressor.

Referring to FIG. 1, a scroll compressor is generally assembled into a welded, sealed, pressure-retaining canister 100. Working components of the compressor include, as shown, a floating seal 115, an internal pressure relief valve 120, a gas by-pass tube 125, an axial compliance guide 130, an Oldham coupling 135 and an unloader bushing 140. Centrally positioned in the canister, there is the compressor unit 145: a housing holding the cranked spiral vanes (not shown) which co-operate to provide compression in use of the compressor. These components are all known and as described in the paper referenced above.

Generally it can be seen that the canister 100 fits closely around the internal components of the compressor, particularly in the region of the compressor unit 145. The floating seal 115 is a component in assembly of the canister about these internal components. The seal 115 must be free to move under pressure to effect a seal against a sealing plate, above it as shown in FIG. 1. It is important to leave a gap for this seal to move in and not for instance to produce a situation in which the plate is kept permanently clamped against the top housing.

The assembly of a new compressor produces a welded, sealed, pressure-retaining canister 100. The factory assembly process is such that internal components are held in correct alignment during both assembly and final welding processes. Cutting into the external hermetic seal provided by the canister 100 in order to make repairs or undertake rebuilding of the compressor means this critical positioning and alignment is lost. Subsequent reassembly is not possible by repeating the original assembly process due to the cutting of the original vessel leading to both material and positioning loss.

Figure 2:
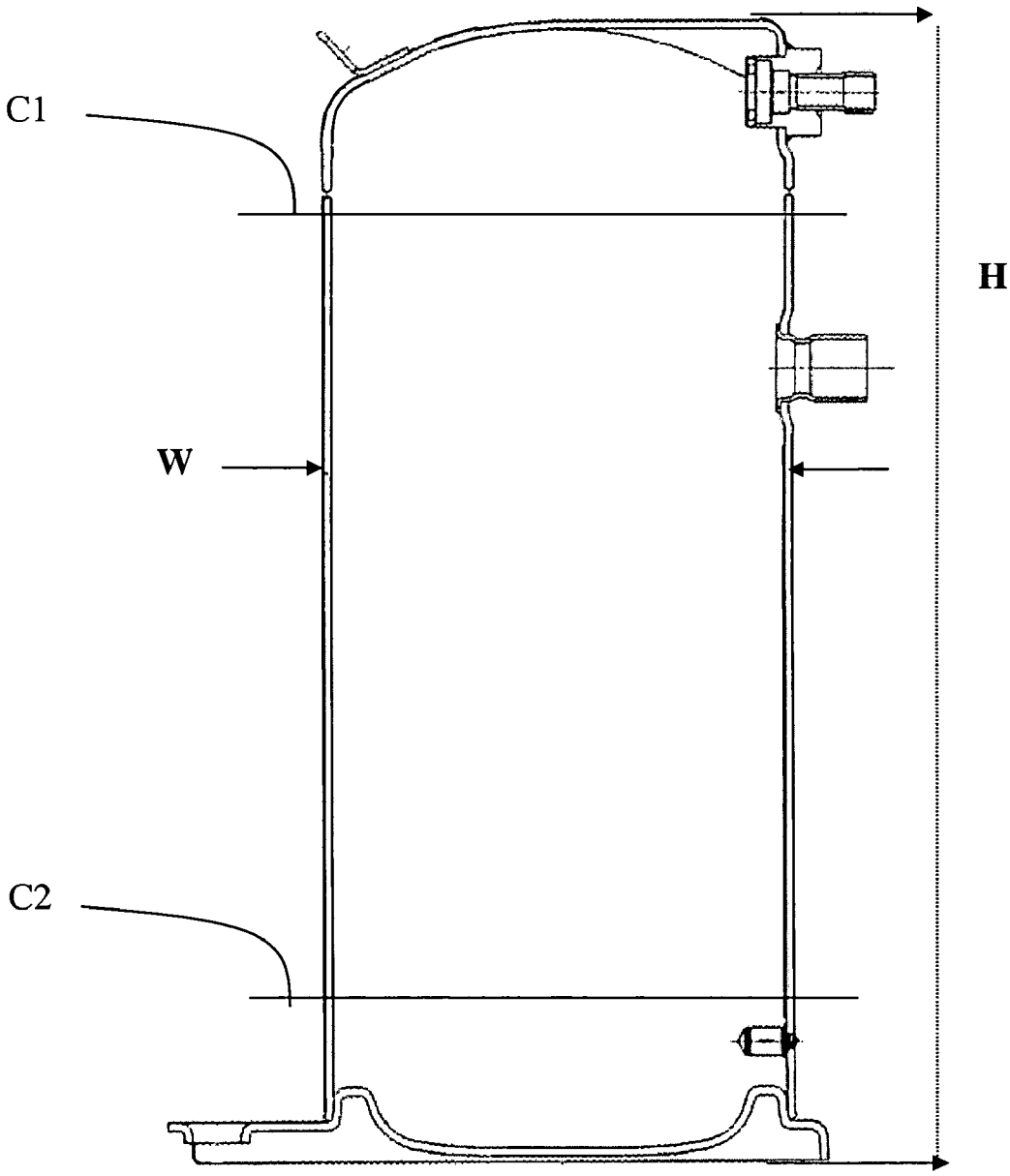
FIG. 2 shows a cross section through the casing of the scroll compressor of FIG. 1, indicating the location of a cutting operation.

Referring to FIG. 2, in embodiments of the present invention, the hermetic chamber provided by the canister 100 of the compressor must be cut open to gain access to the internal components. In order to repair or maintain the cranked spiral vanes, access needs to be gained to the compressor unit 145 in the crowded upper part of the canister 100.

Measurement

In a method according to an embodiment of the invention, the unopened canister 100 is first measured to an accuracy of thousandths of an inch. This is done in the longitudinal direction of the canister 100, giving the height H of the canister 100, and in two orthogonal diametric directions, giving two measurements for the width W of the canister 100. The height H is used during reassembly, to ensure that the repaired canister 100 is the same height, to within thousandths of an inch, as it was before opening. The width W is used to select the correct dimensions for an annular reinforcing structure 300, as shown in FIGS. 3 to 7 and discussed below, for use in reassembly.

Opening

The compressor is rigidly mounted. This can be done in any convenient way, for instance using a machine tool such as a suitably sized lathe, mill, pedestal drill, optionally with a rotary cutting table, or the like. The canister 100 can then be cut open. Still referring to FIG. 2, circumferential cuts are made at two positions C1, C2, a first of these (C1 as shown) being level with a point about halfway up the compressor unit 145 and a second of these (C2 as shown) being near the base of the canister 100. These positions C1, C2 give good access for disassembly and/or removal of the internal components of the canister 100 while giving enough space for reassembly using a reinforcing ring structure as shown in FIGS. 3 to 8 and discussed below. Once cut, the canister 100 can be opened for removal of the compressor unit 145 for repair or replacement.

Scroll compressors are a general type and embodiments of the present invention can be used to remanufacture most or all scroll compressors. A specific example of a scroll compressor in widespread use which can be remanufactured as described herein is the Copeland compressor. Scroll compressors in general have a motor in the main body of the canister 100, this comprising a stator mounted between the two cutting positions C1 and C2 and a main shaft assembly extending through it. The two scrolls of the compressor unit 145 are driven by the main shaft assembly and extend across the upper cutting position C1, as shown in FIG. 2. Once the canister 100 is cut and opened, these components become accessible.

The cutting tool used to cut open the canister 100 will remove a depth of material in the axial direction of the canister 100 which is mainly determined by the thickness of the cutting tool. Thicknesses of material which might be removed at each cut are for example 3 mm or 6 mm. Cutting can be done using known techniques, for example by milling, slitting or using a laser, and using various configurations of equipment. For example, the canister 100 can be mounted on a variety of machine tools which rotate the canister, alternatively the canister can be stationary and the machine tool rotated; such machine tools can be either horizontal or vertical in configuration.

Cutting can be done using known techniques, for example by milling or slitting, and using various configurations of equipment. For example, the canister 100 can be mounted on a lathe and a milling or slitting tool can be used with a milling machine. Another alternative is to use a pedestal drill with a rotary cutting table.

After repair or replacement of the compressor unit 145, the canister 100 is reassembled using a reinforcing ring structure 300 at each cut.

Reinforcing Ring Structure 300

Figure 7:
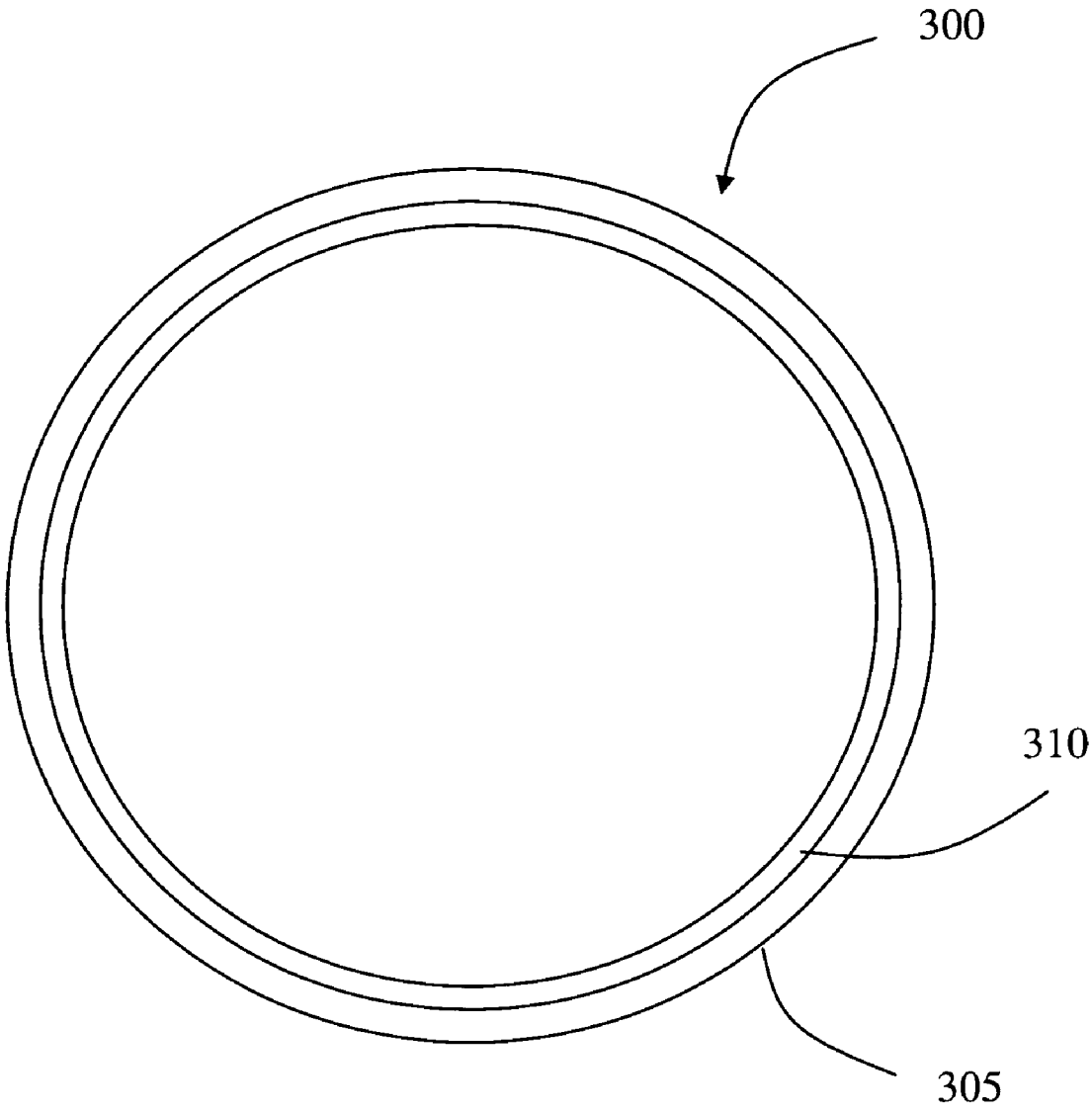
FIG. 7 shows a plan view of the reinforcing structures of FIG. 3.

Referring to FIGS. 3 and 7, a reinforcing ring structure 300 is constructed by turning a low carbon welding grade steel bar, for instance according to the British/European standard BS970-1983 070M20 (EN3B). Alternatively, it would be possible to cut the structure 300 from a seamless tube. The structure 300 has an outwardly projecting flange 305 mounted on a flat-sided ring 310. The outwardly projecting flange 305 projects 2.6 mm. The length of the ring 310 in the axial direction of the canister 100 is 13 mm. The thickness of the flange 305 in the axial direction is 3 mm and the internal diameter of the ring structure 300 overall is 157.6 mm. The thickness of the ring 310 is 1.45 mm.

The material of the ring structure 300 is not necessarily low carbon welding grade steel but will be chosen in known manner, usually primarily according to the welding technique being used.

The dimensions of the ring structure 300 are chosen to match the relevant dimensions of the canister 100, the cutting tool used to make the cuts and the effect of the welding process in reclosing the canister 100. In particular, the ring structure 300 is sized to meet the following criteria:

- to ensure an interference fit between the outer surface of the ring 310 and the internal surface of the canister 100
- to prevent any weld pool from penetrating the canister 100 during reassembly so that the ring 310 is sufficiently thin to ensure clearance with internal compressor components but strong enough to guide the cut parts of the canister 100 in reassembly to compensate for material lost in the cutting process with the thickness of the flange 305, taking into account any further dimensional losses incurred in welding Referring to FIG. 4, in reassembling a canister 100, the ring structure 300 is placed so that the flange 305 sits between cut surfaces of the canister 100 at one of the cutting positions C2. The thickness of the flange 305 (3 mm) and the length of the ring 310 in the axial direction of the canister 100 (13 mm) together mean that the ring 310 will extend to a distance 5 mm away from the finished weld in each axial direction. This is selected to be approximately twice the wall thickness (2.5 mm or 2.6 mm) of the canister 100 in the weld area. Expressed more generally, the ring 310 has a length in the axial direction which is substantially five times, or slightly more than five times, the wall thickness of the canister 100 in the weld area. As mentioned earlier, this has been found to be sufficiently far to prevent any weld pool from penetrating the canister 100 during reassembly. However, depending on the welding technique used, the length of the ring 310 in the axial direction of the canister 100 could be reduced. If the welding technique is selected to avoid material penetrating into the canister 100, the length of the ring 310 in the axial direction of the canister 100 could be reduced to enough to provide location of the sections of the canister 100 at the cutting positions C1 and C2. This might be as little as 0.25 mm away from the finished weld in each axial direction. In this case, the ring 310 has a length in the axial direction which is substantially, or at least, 0.5 mm greater than the thickness of its flange 305.

The dimensions of the ring structure 300 given above will vary according to circumstance, in particular the specific dimensions of a canister 100 being repaired and the cutting method being used. Thus for example, ring structures falling within the ambit of the invention and for use with known canisters 100 might have flanges up to 10 mm thick, up to 4 mm thick, or considerably less.

Reassembly

Referring to FIGS. 2 and 4, once the compressor unit 145 has been repaired, the scroll compressor can be reassembled using a reinforcing ring structure 300 at each of the original cut lines C1, C2 in the canister 100. In more detail, reassembly is carried out as follows:

Fit top bearing to the housing of the compressor unit 145

Refit stator of motor to the main section of the canister 100, between cut lines C1 and C2

Fit main shaft assembly into the stator in the main section of the canister 100

Fit new lower bearing to the housing of the compressor unit 145

Fit a reinforcing ring structure 300 at the lower cut line C2 in the canister 100, as shown in FIG. 2

Fit main section of the canister 100 onto the reinforcing ring structure 300 at the lower cut line C2 in the canister 100

Fit eccentric bush to main shaft

Fit lower and upper scrolls into the compressor unit 145

Fit and tighten scroll clamping bolts with spacers

Fit a reinforcing ring structure 300 at the upper cut line C1 in the canister 100, as shown in FIG. 2

Fit axial seal

Fit top dome section of canister onto the reinforcing ring structure 300 at the upper cut line C1 (relief valve previously checked and replaced as necessary)

Rotationally align the three sections of the canister 100 by turning the sections relative to one another at the cut lines C1 and C2

Fit axial clamping alignment fixture to the canister 100

Mount on welding bed

Weld top and bottom joints at cut lines C1 and C2.

With MIG welding, additional filler rod/wire is required but it is possible with TIG welding to size the reinforcing ring structures 300 such that no filler rod/wire is required.

Known scroll compressor canisters 100 in practice have a weld in the axial direction as a result of the original manufacturing process. The step of rotationally aligning the three sections of the canister 100 mentioned above can conveniently be done with reference to this axial weld as a datum. Accuracy in the rotational alignment of the parts of the canister 100 is not as critical as accuracy in the reconstruction of the canister 100 in the axial direction. Rotational accuracy is only necessary to an extent allowing the correct connections to be made within the canister 100.

Figure 8:
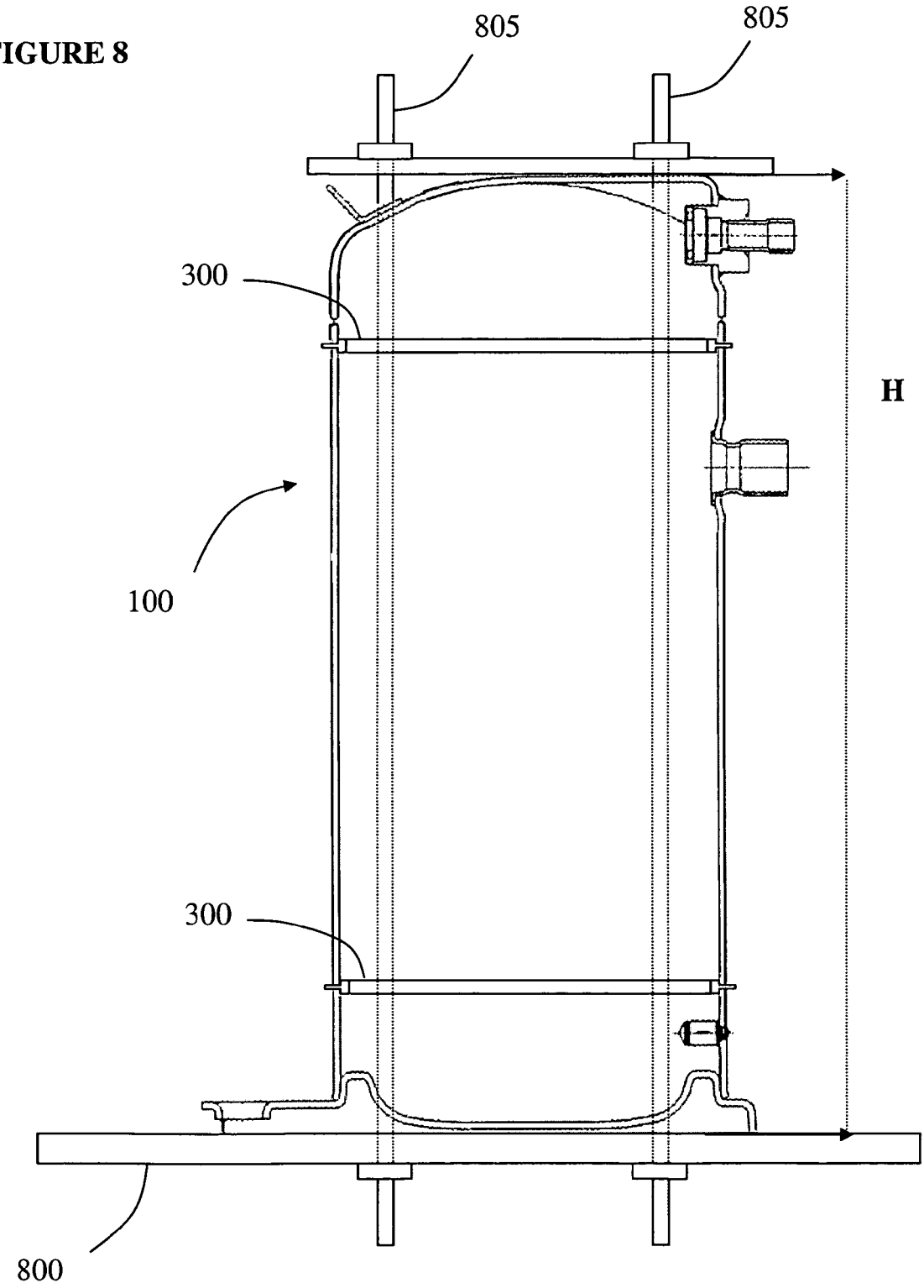
FIG. 8 shows a vertical cross section of the casing of the scroll compressor of FIG. 1, fitted with two of the reinforcing structures of FIG. 3 and held in position on a bench prior to welding.

Referring to FIG. 8, the axial clamping alignment fixture mentioned above must hold the parts of the canister 100 during welding. It can be provided in more than one way but one solution is to use an assembly bench 800 which has been drilled and tapped to take a series of long studs 805. Once the canister 100 is assembled on the bench 800, using two ring structures 300, these long studs 805 are screwed in to the bench 800 and a top plate 810 added. A clamping pressure is applied via the top plate 810 so that the height H of the canister 100, measured before opening, can be restored to within thousandths of an inch after welding. The canister 100 is then tack welded on the bench 800 before being moved to welding equipment for final welding.

The height H can be measured in known manner, using for example a Vernier height gauge or the like.

In an alternative arrangement to that described above, it would be possible to implement both the cutting open and the final welding of the canister 100 on a modified pillar drill with cutting and welding attachments. The welding step could then conveniently be automated by presetting the position of the welding equipment in relation to the drill and setting a rotational speed to achieve an acceptable weld. A pillar drill usually has a support for an item to be worked on, plus a drill head, but the pillar can also be used to support other equipment in relation to the item, such as jigs and attachments for setting, retaining alignment, machining and welding as necessary.

In a further alternative arrangement, it would be possible to use a similarly modified milling machine in place of the pillar drill.

Alternative Reinforcing Ring Structures 300

Figure 5:
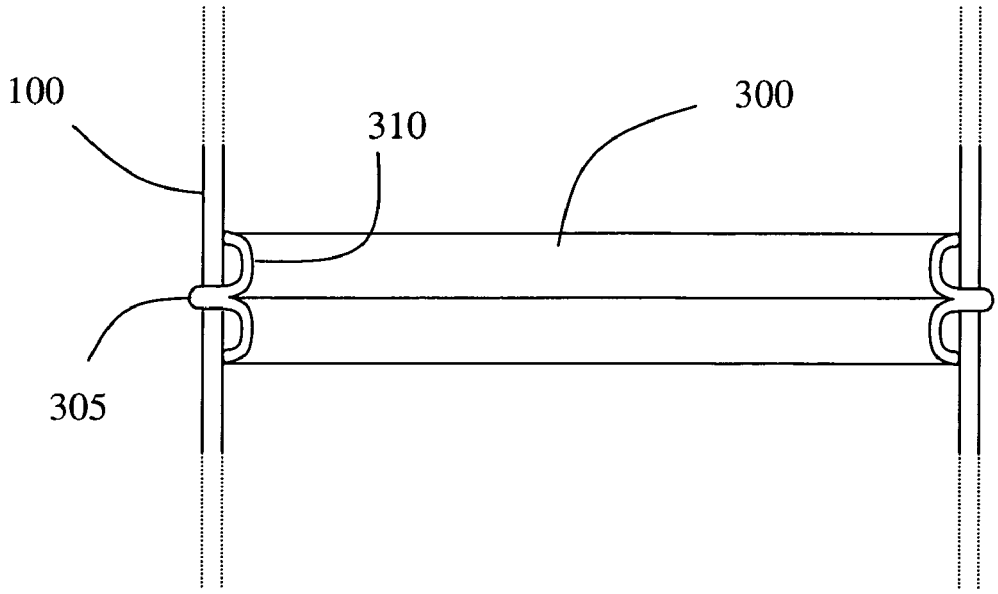
FIGS. 5 and 6 show cross sections through annular reinforcing structures of alternative profiles.
Figure 6:
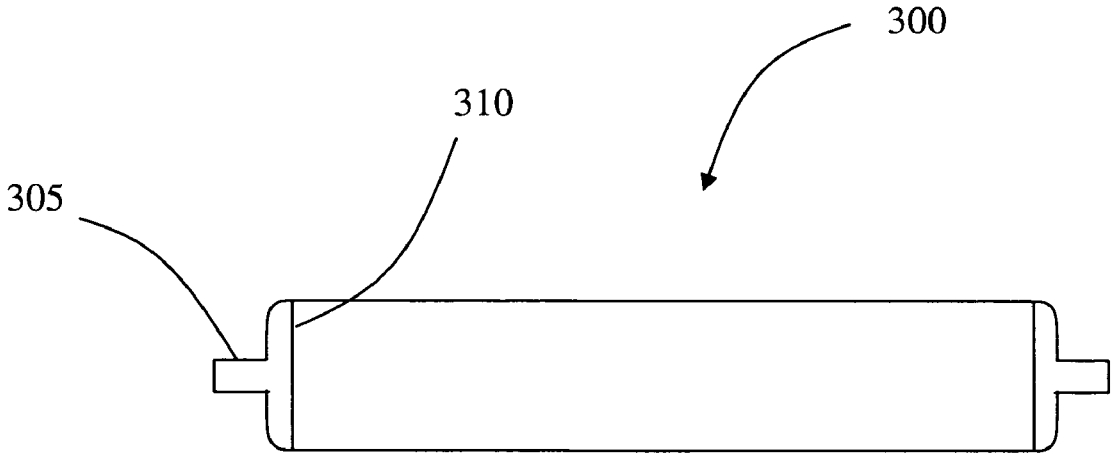

Referring to FIGS. 5 and 6, it is not essential that the ring 310 of the ring structure 300 has a flat outer surface. In the ring structure of FIG. 5, the outer surface of the ring 310 is concave and just the tips of it, at top and bottom as shown, provide the interference fit with the internal surface of the canister 100 in use. In the ring structure of FIG. 6, the outer surface of the ring 310 is rounded off at top and bottom as shown. Either of these variations can potentially make the process of reassembling the canister 100 easier.

What is claimed is:

1. A method of repairing a scroll compressor having a casing which provides positioning for internal components of the compressor in relation to each other, the method comprising the steps of:

i) making a transverse cut through the casing of the scroll compressor so as to gain access to one or more of said internal components; and ii) welding the cut surfaces of the casing to an annular reinforcing structure having a T-shaped cross section such that the cut surfaces abut opposing sides of an outwardly directed flange of the reinforcing structure, the flange being mounted on a ring whose outer surface abuts inner surfaces of the casing, wherein the closed casing is supported and sealed by the reinforcing structure.

2. A method according to claim 1 which comprises making two transverse cuts through the casing and welding the cut surfaces of the casing to each of two such annular reinforcing structures, such that the welded casing is supported and sealed by the two reinforcing structures.

3. A method according to claim 1 wherein the step of welding the cut surfaces comprises a single pass welding step.

* * * * *